United States Patent [19]

Story

[11] 4,292,777

[45] Oct. 6, 1981

[54] INSULATION-CONFINING PANEL AND METHOD OF USING THE SAME

[76] Inventor: Edward R. Story, 4985 N. Cascade Pl., Oak Harbor, Wash. 98277

[21] Appl. No.: 84,517

[22] Filed: Oct. 12, 1979

Related U.S. Application Data

[63] Continuation-in-part of Ser. No. 949,895, Oct. 10, 1978, abandoned.

[51] Int. Cl.[3] ..... E04B 2/00

[52] U.S. Cl. ..... 52/407; 52/743

[58] Field of Search ..... 52/317, 743, 404, 407; 428/121, 182, 313; 206/491

[56] References Cited

U.S. PATENT DOCUMENTS

| | | | |
|---|---|---|---|
| 1,924,515 | 8/1933 | Reinke | 52/407 |
| 2,099,589 | 11/1937 | Armbruster | 52/405 |
| 2,218,465 | 10/1940 | Gunnison | 52/317 |
| 2,238,022 | 4/1941 | Johnson | 52/404 |
| 2,283,257 | 5/1942 | Jorsch | 52/406 |
| 2,576,698 | 11/1951 | Russum | 52/406 |
| 2,788,552 | 4/1957 | Miles | 52/743 |
| 2,934,465 | 4/1960 | Warp | 52/407 |
| 3,337,113 | 8/1967 | Harrison | 206/491 |
| 4,125,982 | 11/1978 | Ward | 52/743 |

*Primary Examiner*—James L. Ridgill

*Attorney, Agent, or Firm*—Ward Brown; Robert W. Beach

[57] ABSTRACT

A rectangular cardboard sheet has two parallel longitudinal scores, each spaced inward of a longitudinal sheet edge, and two lateral parallel scores, each spaced inward of a lateral sheet edge, forming a rectangular sheet central portion and rectangular bendable margins. The width of the sheet central portion is substantially the same as the distance between adjacent floor or ceiling joists of a building structure. The longitudinal sheet margins have several transverse slots dividing such margins into rows of separate tabs. Tabs at opposite sides of the sheet can be secured to adjacent joists such that the sheet central portion bridges between the joists, parallel to and spaced from the building structure ceiling or floor, for holding a layer of blowable insulation material against the ceiling or floor.

20 Claims, 18 Drawing Figures

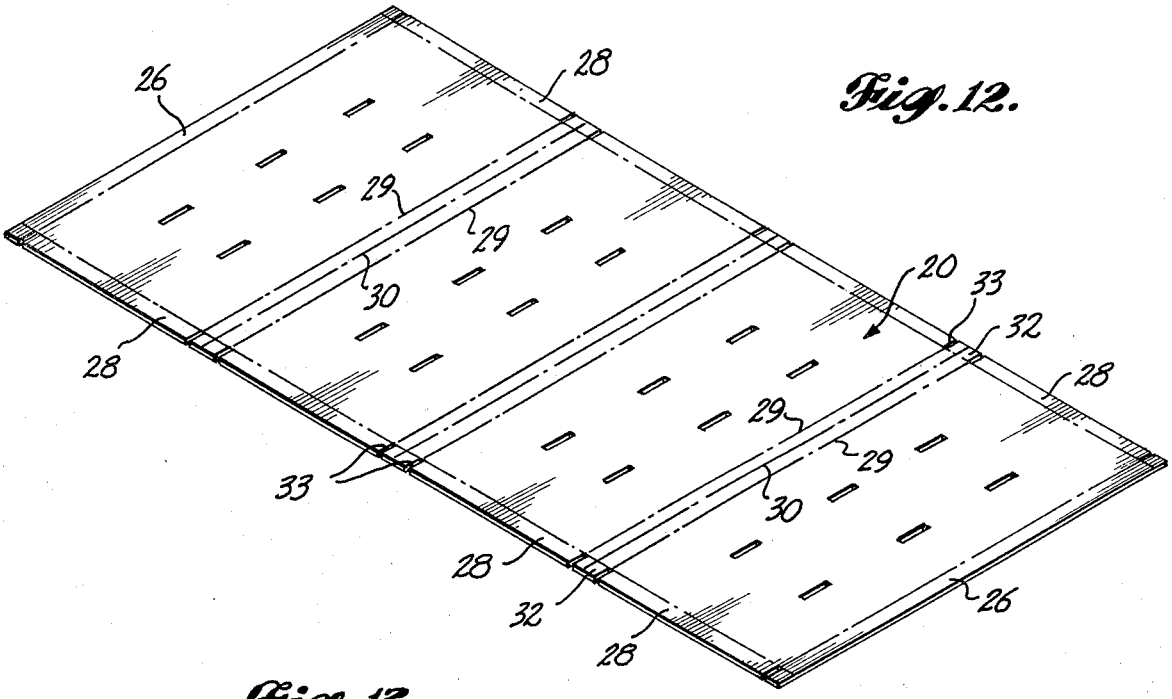
Fig. 12.
Fig. 13.
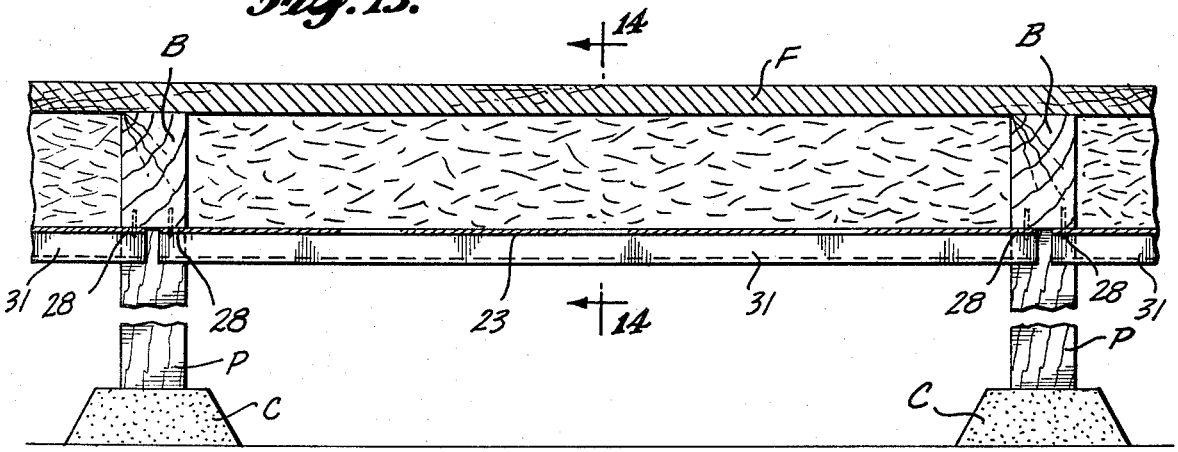
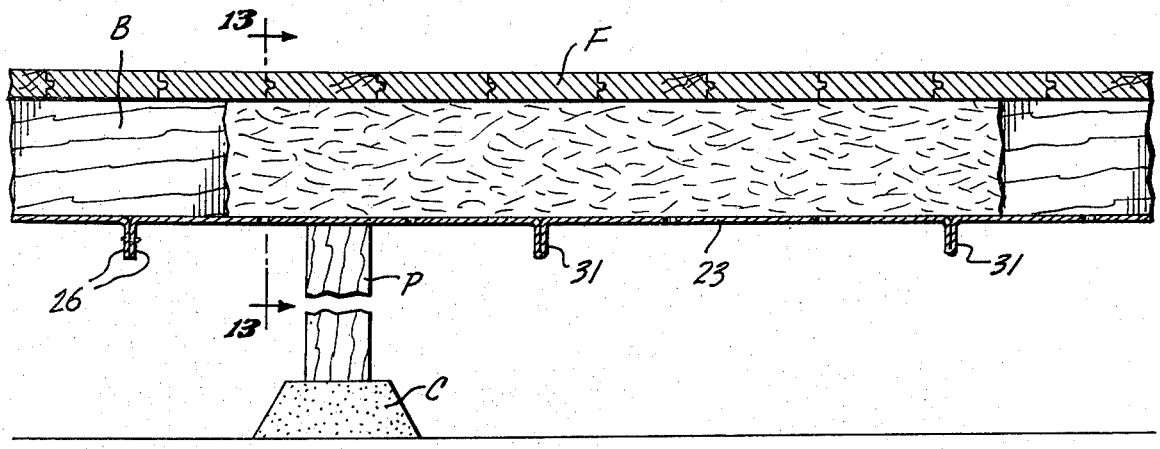
Fig. 14.

INSULATION-CONFINING PANEL AND METHOD OF USING THE SAME

CROSS-REFERENCE

This application is a continuation-in-part of my copending U.S. patent application Ser. No. 949,895, filed Oct. 10, 1978 for Insulation-Confining Panel, now abandoned.

BACKGROUND OF THE INVENTION

1. Field of the Invention

The present invention relates to generally horizontal panel structure for confining blowable insulation material between the joists of a building structure.

2. Prior Art

Various types of insulating materials and methods for applying such materials are known for heat insulating a building structure under construction or constructed. Insulation materials have been supplied as rigid sheets or rolled strips or batts which were secured in position underneath the roof, above the ceiling, inside the walls or under the floor of the structure.

Although older structure-insulating materials and methods continue to be used, there has been increased use of insulation material which may be blown or sprayed into position through a hose, such as particulate or comminuted rock wool, cellulose or fiber glass, or any of various types of particulate or comminuted foams. All of such materials can be referred to as "blowable" or "blown" insulation materials.

A problem with particulate or comminuted blown insulation material is that it settles after installation, decreasing the thickness of the applied insulating layer and reducing the insulating value of the layer. For example, it is known to blow particulate insulation material into the attic of a structure having a horizontal ceiling to be supported by the ceiling. After a period of time the thickness of such layer is reduced by settling of the particulate material to a point where the insulating value of the layer is one-half or less of its original value.

For good reasons, there are at least two situations in which blowable insulation material has not been used extensively. First, blown insulation material has not been used successfully for heat insulating floors because most building structures as built do not have insulation-supporting surfaces beneath the floor. Second, when the roof of a building is close to the building ceiling, such as when inclined roof rafters also function as inclined ceiling joists for an openbeam or "vaulted" ceiling, blown insulation material would substantially fill the space between the roof and ceiling and eliminate air ventilation to the underside of the roof which could lead to premature deterioration of the roof. In addition, cellulose or other particulate paper insulation materials would soak up condensation which reduces its insulation value and may damage the ceiling.

SUMMARY OF THE INVENTION

The principal object of the present invention is to provide apparatus and a method for confining blown insulation material against a generally horizontal surface supported by the joists of a building structure.

In accordance with the principal object, it is an object to provide such apparatus in a form ensuring that a uniform insulating layer of a desired thickness will be confined against the surface supported by the joists and that the thickness of such layer will not decrease substantially by settling of the blown insulation material.

Another object is to provide an insulation-confining panel adaptable to support blown insulation material between floor joists.

A further object is to provide such a panel adaptable to confine blown insulation material against a ceiling disposed parallel and close to a roof without cutting off air ventilation to the underside of the roof.

It is also an object to provide such a panel which may be installed quickly, easily and inexpensively, yet permanently.

These objects can be accomplished by providing a sheet of substantially rigid material, such as corrugated cardboard, having two parallel scores each spaced inward of an edge of the sheet and dividing the sheet into opposite marginal portions and a substantially rectangular central portion of a width approximately equal to the distance between adjacent joists. The central portion of the sheet has several ventilation apertures scattered substantially uniformly throughout such central portion.

In floor applications, tabs at opposite sides of the sheet are secured to adjacent floor joists with the sheet central portion bridging between the joists, parallel to and below the floor, and a layer of insulation material is blown onto and supported by the sheet central portion to substantially fill the space between the sheet and the floor. As the insulation material is blown into position, air blown with the material escapes through vent slits spaced throughout the sheet central portion so that a compact mass of insulation material is confined between the sheet central portion and the underside of the floor.

In ceiling applications, tabs at opposite sides of the sheet are secured to adjacent ceiling joists with the sheet central portion bridging between the joists, parallel to and above the ceiling but spaced below the underside of the roof. Insulation material is blown between the ceiling and the sheet central portion leaving an unobstructed air space between the sheet central portion and the underside of the roof.

BRIEF DESCRIPTION OF THE DRAWINGS

FIG. 12 is a top perspective of another alternative embodiment of an insulation-confining panel in accordance with the present invention, FIG. 13 is a fragmentary vertical section of a building structure showing the insulation-confining panel of FIG. 12 installed on adjacent floor-supporting members, and FIG. 14 is a section taken on line 14—14 of FIG. 13.

DETAILED DESCRIPTION

Figure 1:
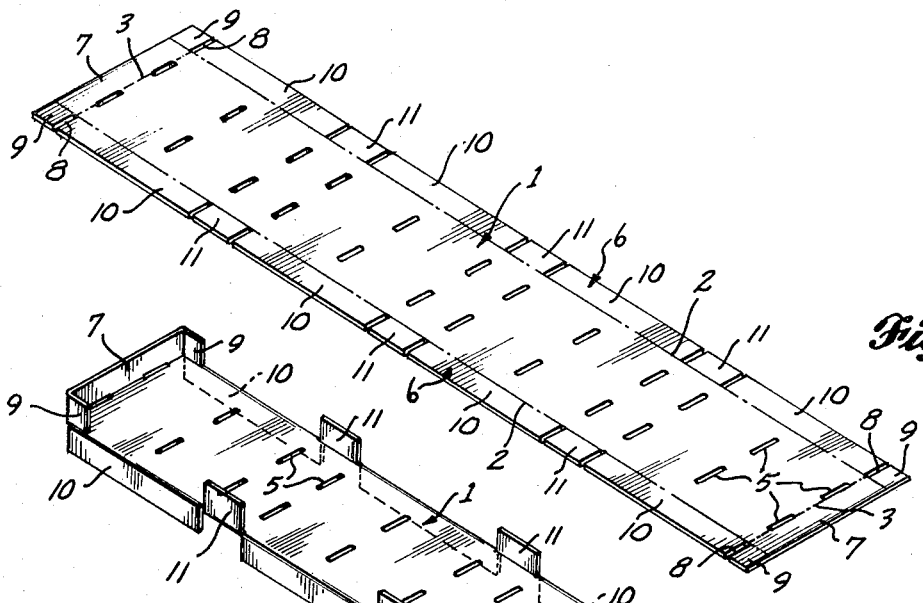
FIG. 1 is a top perspective of an insulation-confining panel in accordance with the present invention.

As shown in FIG. 1, in one embodiment of the present invention an insulation-confining panel includes a rectangular sheet 1 of substantially rigid material such as corrugated cardboard having waxed fluting secured to outer paper surfaces by vapor resistant glue. The sheet has two longitudinally extending parallel scores 2 each spaced inward of a longitudinal sheet edge and transverse or lateral scores 3 each spaced inward of a lateral sheet edge. The scores divide the sheet into a rectangular central portion 4 having several small ventilation slits 5, opposite longitudinal or side marginal portions 6 and opposite lateral or end marginal portions 7.

Each of several slots 8 extends widthwise of the sheet from a longitudinal sheet edge up to the longitudinal score 2 closer to that edge. Such slots divide each sheet longitudinal marginal portion 6 into corner tabs 9 of a width approximately equal to the width of the sheet lateral marginal portions 7, long panel-securing tabs 10 and short spacer tabs 11 located between adjacent panel-securing tabs 10. Each tab is bendable in either direction along a score 2 as to be disposed perpendicular to the sheet central portion 4.

Figure 2:
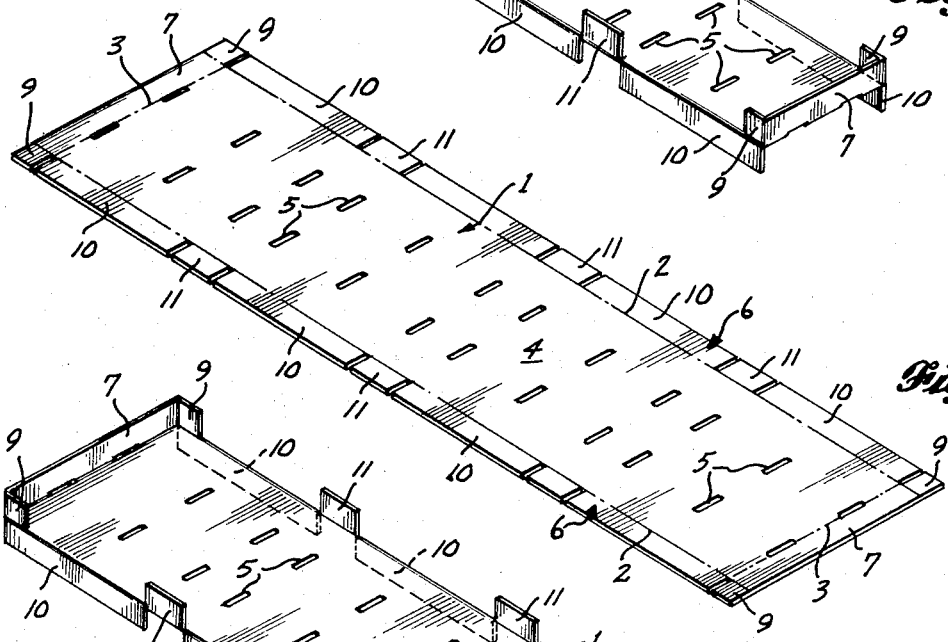
FIG. 2 is a top perspective of an alternative form of panel in accordance with the present invention, identical to the panel of FIG. 1 except for dimensions.

The width of the sheet central portion is selected to be slightly less than the distance between adjacent joists of the parallel, uniformly spaced joists of a building structure for supporting a generally horizontal planar surface, namely a ceiling or a floor. For example, the width of the central portion 4 of the panel in FIG. 1 is about $14\frac{1}{4}$ inches (36.2 cm), that is, slightly less than the $14\frac{1}{2}$ inch (36.8 cm) distance between adjacent "2×6" or "2×8" joists spaced apart 16 inches (40.6 cm) on center. The width of the central portion of the panel of FIG. 2 is about $22\frac{1}{4}$ inches (56.5 cm), that is, slightly less than the $22\frac{1}{2}$ inch (57.1 cm) distance between "2×6" or "2×8" joists spaced 24 inches (61.0 cm) on center. In other respects, the panels of FIGS. 1 and 2 are identical.

Figure 4:
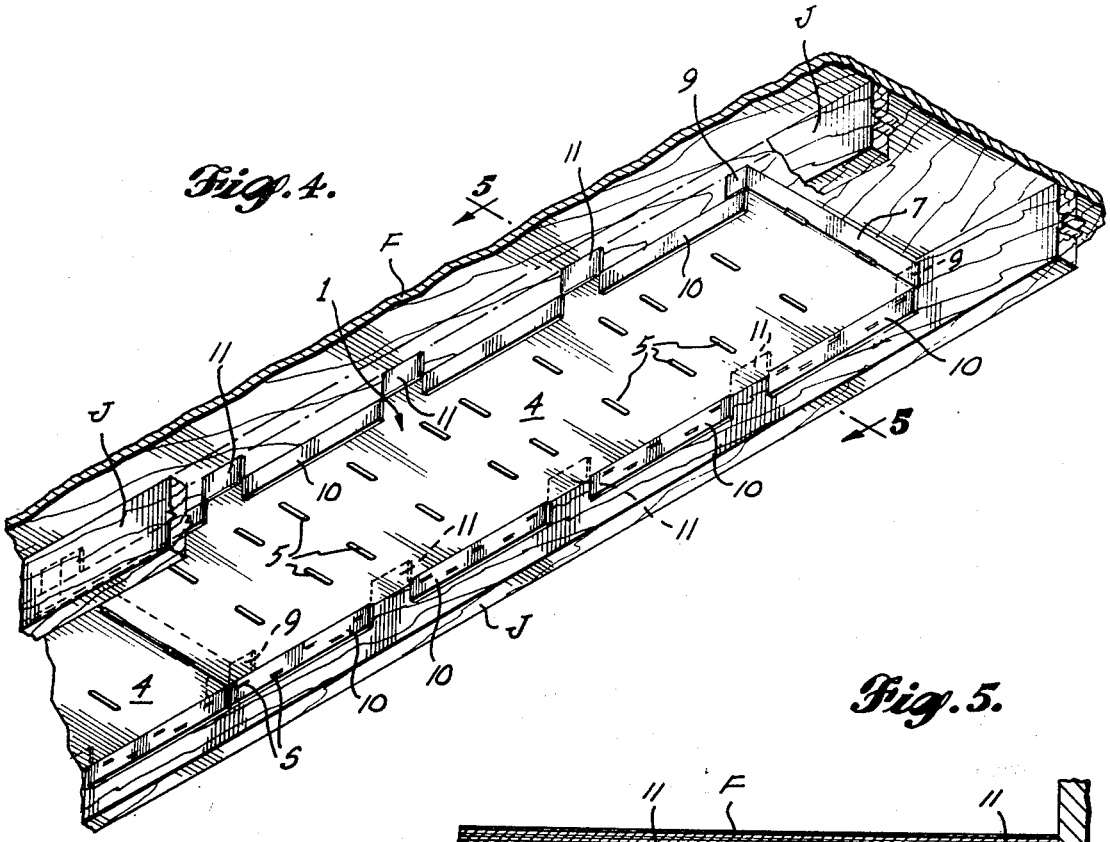
FIG. 4 is a fragmentary bottom perspective of a floor-supporting system of a building structure including a floor showing an insulation-confining panel in accordance with the present invention installed between adjacent floor joists.
Figure 5:
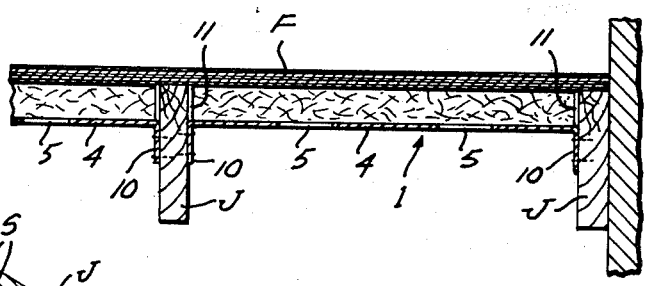
FIG. 5 is a section taken on line 5—5 of FIG. 4.
Figure 3:
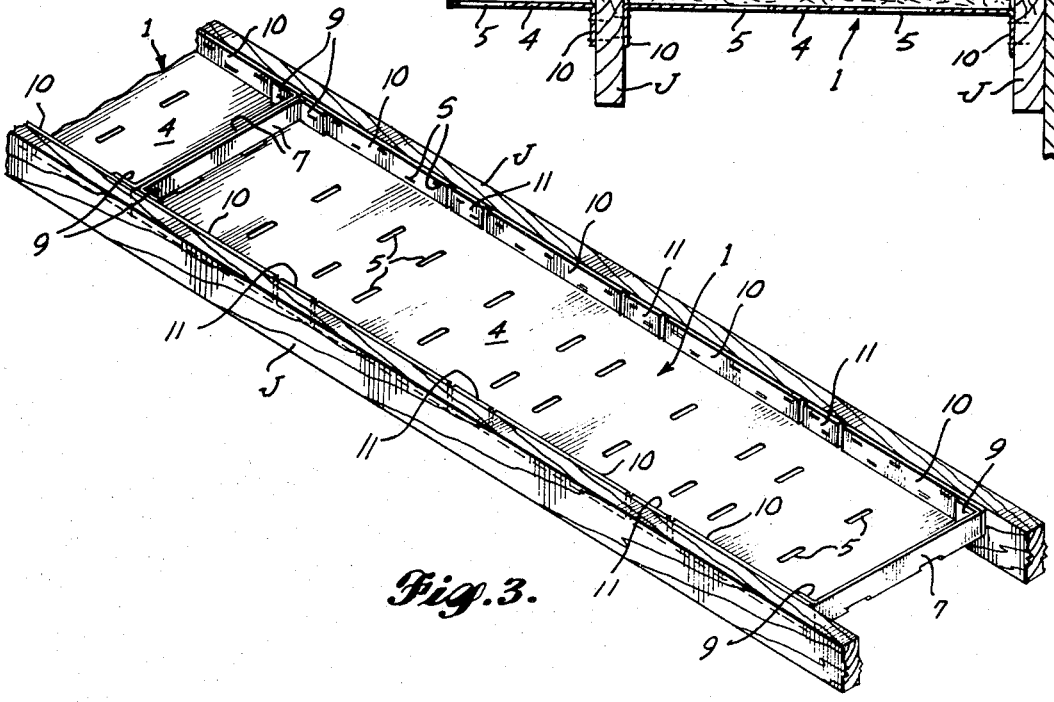
FIG. 3 is a fragmentary top perspective of a floor-supporting system of a building structure without a floor showing an insulation-confining panel in accordance with the present invention installed between adjacent floor joists.

A panel in accordance with the present invention can be installed as shown in FIG. 3 or in FIGS. 4 and 5 to support blowable insulation material above the sheet central portion 4 of FIG. 3, or between floor joists and against the floor as shown in FIGS. 4 and 5. As shown in FIG. 3, for new construction in which the floor has not yet been installed over floor joists J, the panel lateral margins 7 are bent upward forming end flanges perpendicular to the panel central portion 4, and the corner tabs 9 are folded inward. Next, the panel-securing and spacer tabs 10 and 11, respectively, are folded upward forming an insulation-holding tray.

The panel is inserted between adjacent joists J and positioned such that the outer tab edges are in alignment with the upper edges of the joists. The tabs are secured to the facing surfaces of the joists, such as by staples S, and support the sheet central portion 4 bridging between adjacent joists. As shown in FIG. 3, panels may be positioned and secured end-to-end with their upward bent lateral margins 7 abutting to form a substantially continuous tray between the joists.

The tabs position the sheet central portion 4 parallel to the tops of the joists and below them a distance equal to the width of the tabs. The tab width is selected to be approximately equal to the depth of the insulation material required to yield the desired insulation "R" value. In the embodiments of FIGS. 1 and 2, all of the tabs are about $2\frac{3}{4}$ inches (7.0 cm) wide.

Insulation material then is blown into the space above the panels and is supported by the sheet central portions 4. After the building structure flooring is installed, the panel central portions confine such insulation material beneath the underside of the flooring.

Figure 1A:
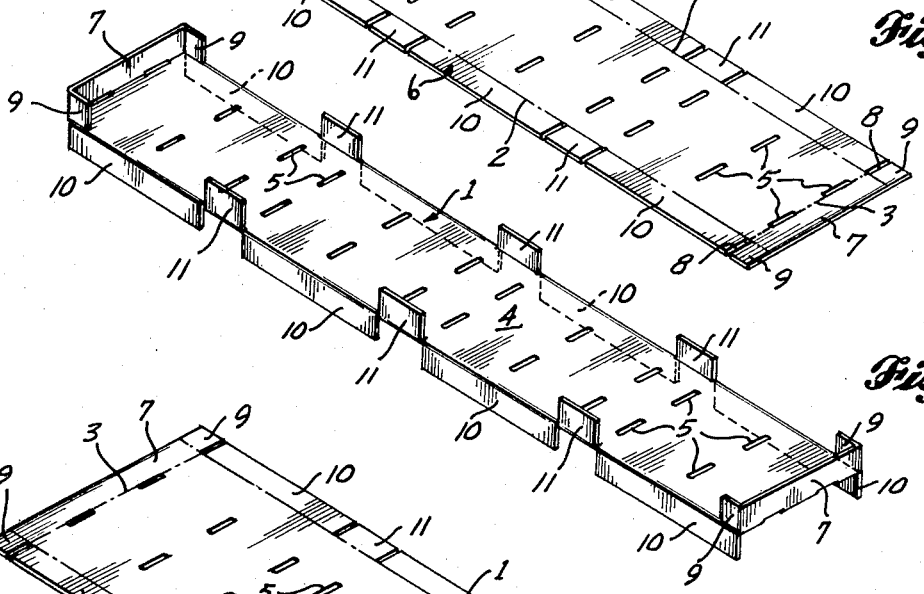
FIG. 1*a* is a top perspective of the panel of FIG. 1 prepared for being fitted between adjacent joists of a building structure.
Figure 2A:
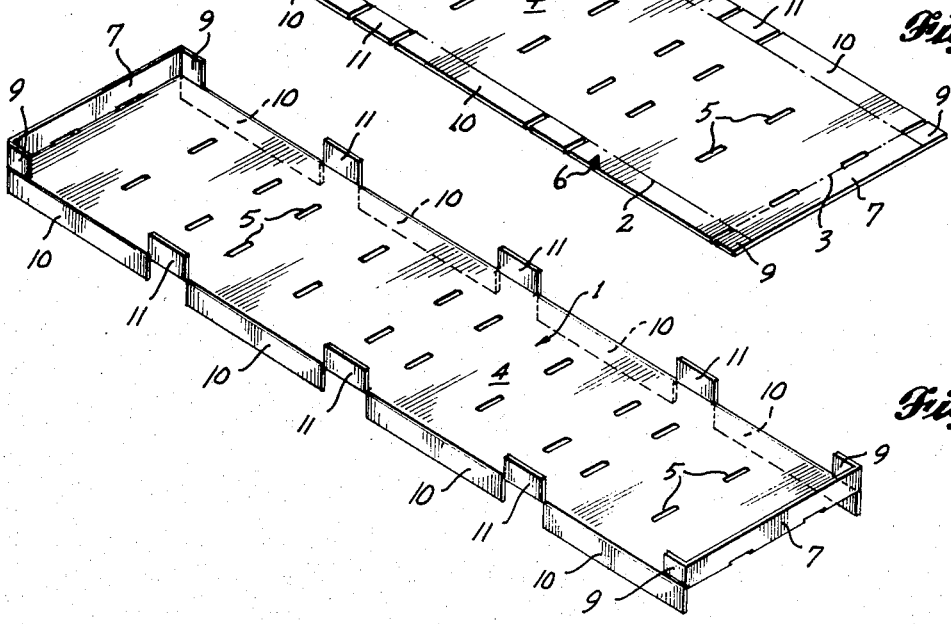
FIG. 2*a* is a top perspective of the panel of FIG. 2 prepared for being fitted between adjacent joists of a building structure.

Panels in accordance with the present invention are particularly useful for installing blowable insulation material after the building structure flooring has been applied over the floor joists. In this case, as shown in FIGS. 1*a*, 2*a* and 4, the sheet lateral marginal portions 7 are bent upward, the corner tabs 9 are bent inward and the short spacer tabs 11 are bent upward. The long panel-securing tabs 10 are bent downward, that is, in the direction opposite tabs 11.

As shown in FIGS. 4 and 5, the sheet having bent tabs is inserted between adjacent joists J from below and moved upward until the outer edges of the lateral sheet margins 7, corner tabs 9 and spacer tabs 11 all are aligned with the upper edges of joists J and are in substantially contiguous engagement with the underside of the flooring F supported by the joists. The longer panel-securing tabs 10 bent downward are secured to the facing surfaces of the joists, such as by staples S. Consequently, the sheet central portion 4 bridges between adjacent joists, substantially parallel to the underside of flooring F and below it a distance equal to the width of the upward projecting tabs 11. Insulation material is blown between the flooring and the sheet central portions such as by cutting holes in the sheet central portions from below at intervals lengthwise of the floor joists J and inserting the insulation material-blowing hose through such holes. When the insulation-confining space between flooring F and a sheet central portion 4 is full of insulation material, as shown in FIG. 5, the hose is removed and the hole can be taped.

Figure 6:
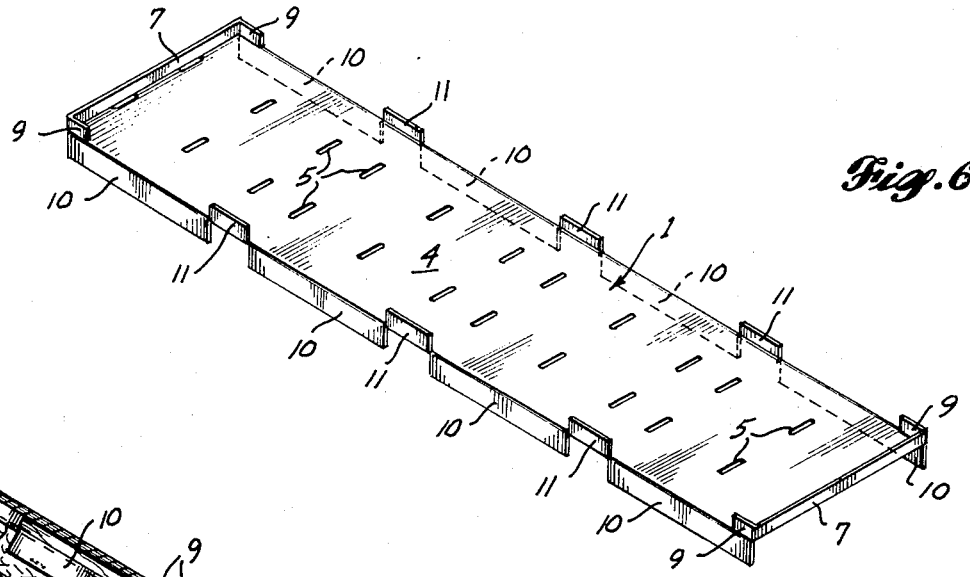
FIG. 6 is a top perspective of an alternative embodiment of an insulation-confining panel in accordance with the present invention.
Figure 7:
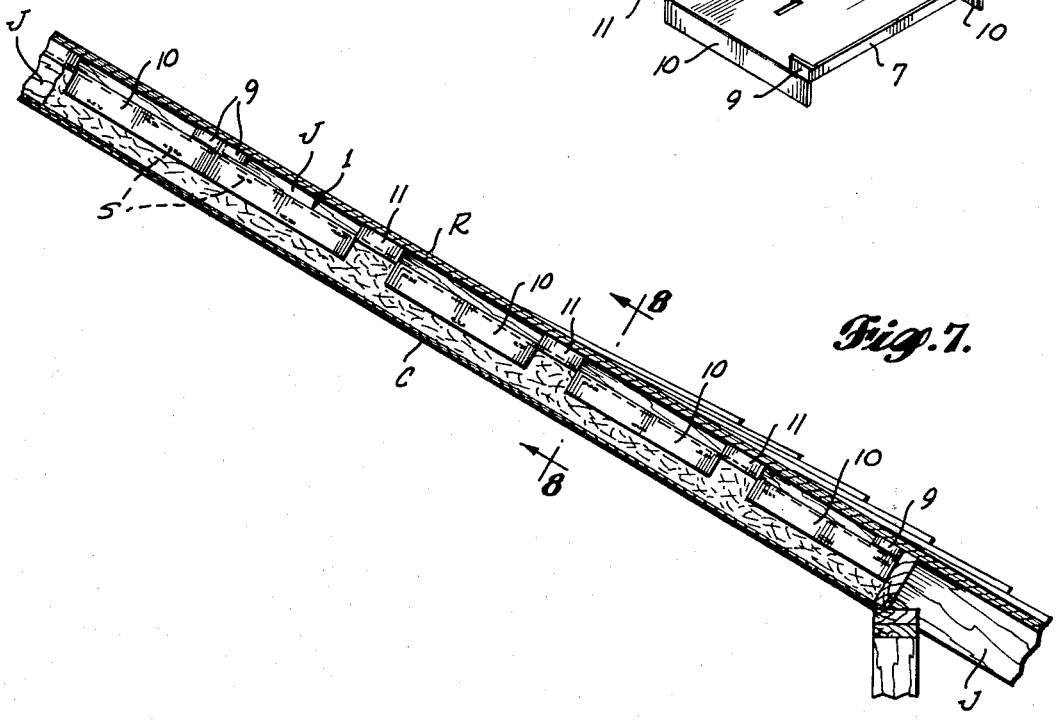
FIG. 7 is a fragmentary vertical section of a roof-supporting system of a building structure showing the insulation-confining panel of FIG. 6 installed between adjacent ceiling joists.
Figure 8:
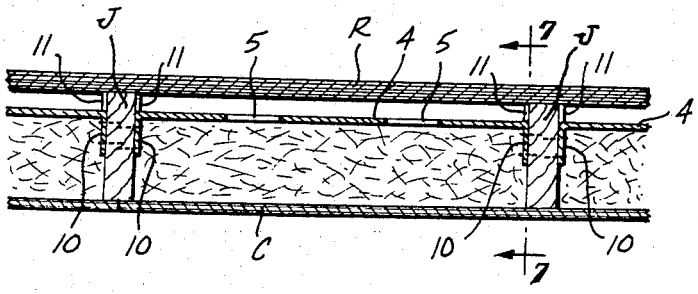
FIG. 8 is a section taken on line 8—8 of FIG. 7.

The insulation-confining panel in accordance with the present invention shown in FIG. 6 has been modified for being installed as shown in FIGS. 7 and 8 between adjacent inclined roof rafters which also function as ceiling joists J for the ceiling surface C. The only difference between the panel of FIG. 6 and the panels of FIGS. 1 and 2 is that the lateral sheet marginal portions 7, corner tabs 9 and spacer tabs 11 have been trimmed to a width of about 1 inch (2.5 cm) so as to form an air space of that thickness beneath the roof. As best seen in FIG. 6, prior to installation, the sheet margins and tabs are bent as described with reference to the floor installations of FIGS. 4 and 5.

Similar to the installations previously described, the panel of FIG. 6 is inserted between adjacent ceiling joists J and positioned with the outer edges of spacer tabs 11, corner tabs 9 and the lateral sheet marginal portions 7 in alignment with the upper edges of the joists so that such tabs and marginal portions will be in substantially contiguous engagement with the roof sheathing R as shown in FIGS. 7 and 8. The panel-securing tabs 11 are secured to the facing joist surfaces, such as by staples S, and support the sheet central portion 4 bridging between adjacent joists. Later, after a section of the ceiling surface C has been installed, insulation material is blown into the insulation-confining space between such surface and the sheet central portions 4 to substantially fill the space as shown in FIG. 8. Alternatively, holes can be cut in a completely installed ceiling surface for the insulation-blowing hose, and such holes can be patched after the insulation-blowing process has been completed. Since the panel central portion is spaced below the roof sheathing a distance equal to the width of the upward-projecting tabs, there is an air ventilation space between the roof sheathing and the insulation material.

In some roof installations it may not be necessary to trim the upward-projecting panel tabs. For example, the building structure of FIGS. 7 and 8 uses "2×6" roof rafters/ceiling joists and only a 1 inch (2.5 cm) air space is desired so that approximately $4\frac{1}{4}$ inches (10.8 cm) of insulation material is confined against ceiling surface C by the panels. If a thinner layer of insulation material is desired, or if larger ceiling joists are used, the tabs could be wider. For example, if "2×8" roof rafter/ceiling joists are used, upward-projecting tabs $2\frac{3}{4}$ inch (7.0 cm) wide would allow room for about $4\frac{1}{2}$ inches (11.4 cm) of blowable insulation material above the ceiling surface.

Figure 9:
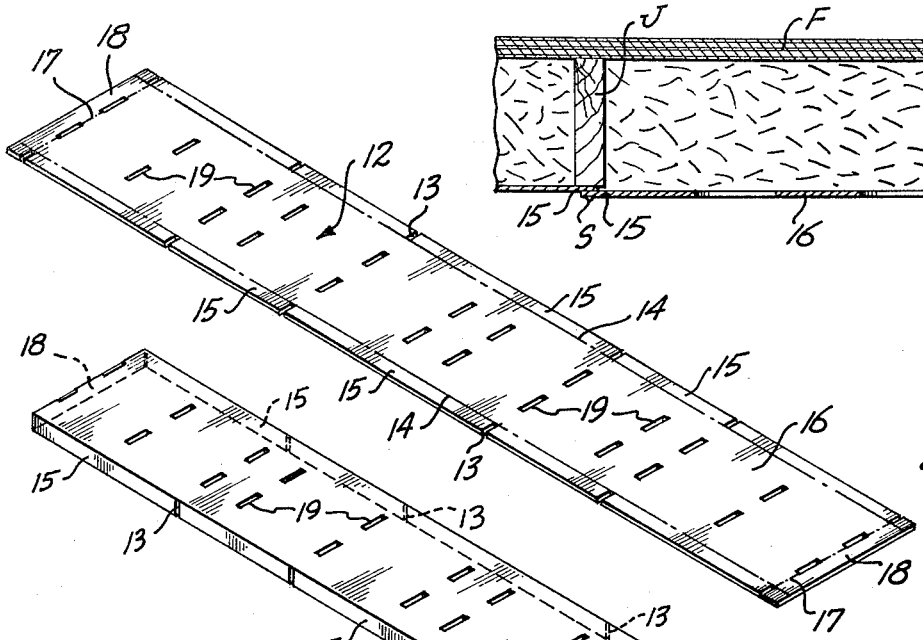
FIG. 9 is a top perspective of another alternative embodiment of an insulation-confining panel in accordance with the present invention.

As in the previously described embodiments, the embodiment of the present invention shown in FIG. 9 includes a generally rectangular semi-rigid sheet 12, preferably of corrugated cardboard. Slots 13 extend widthwise of the sheet from a longitudinal sheet edge up to the nearer of two parallel longitudinally extending scores 14 forming several long panel-securing tabs 15 at opposite sides of a rectangular sheet central portion 16. The width of such central portion is approximately equal to the distance between adjacent joists of a building structure. Transverse or lateral scores 17 are spaced inward of opposite ends of the sheet for forming end tabs 18 of a width approximately equal to the width of the long panel-securing tabs 13. The sheet central portion has several ventilation slits 19.

Figure 10:
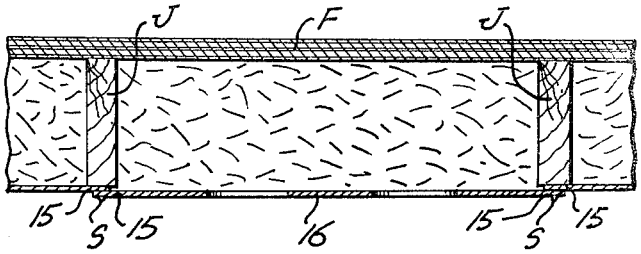
FIG. 10 is a fragmentary vertical section of a building structure showing the insulation-confining panel of FIG. 9 installed on adjacent floor joists.

For providing a deep insulation-confining space beneath the floor of a building structure, a sheet in accordance with FIG. 9, or any of the other previously described embodiments, can be installed as shown in FIG. 10. In this instance, none of the sheet tabs are bent, but rather the longitudinally extending tabs 15 are secured to the bottom faces of uniformly spaced floor joists J, such as by staples S, such that the sheet central portion 16 bridges between such joists. Insulation then can be blown between the sheet central portion and flooring F as previously described.

Figure 9A:
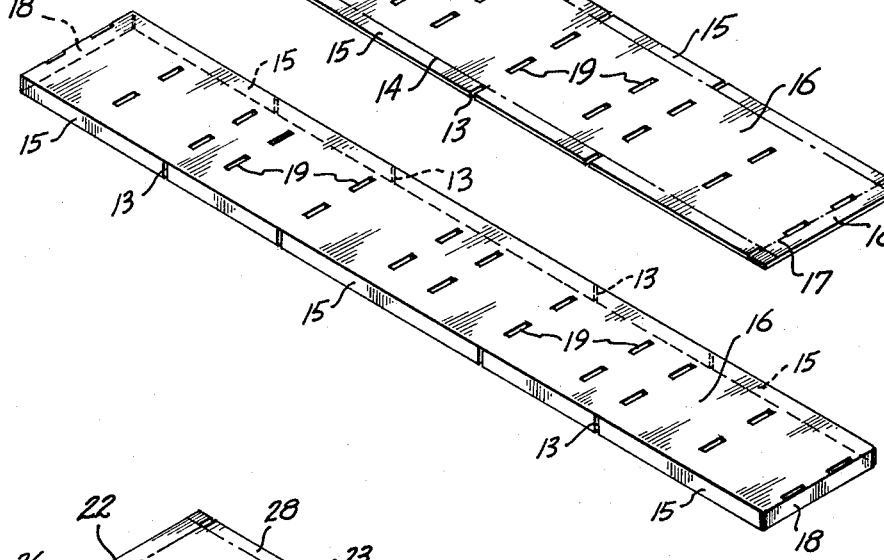
FIG. 9*a* is a top perspective of the panel of FIG. 9 prepared for being fitted between adjacent joists of a building structure.

Alternatively, the panel of FIG. 9 can be prepared for being inserted between adjacent floor or ceiling joists by bending all of the tabs in the same direction, preferably downward as shown in FIG. 9*a*. Long panel-securing tabs 15 at opposite sides of the sheet can be secured to the facing surfaces of adjacent joists for supporting the panel central portion 16 at any desired distance from a floor or a ceiling up to a maximum distance of the depth of such joists.

Figure 11:
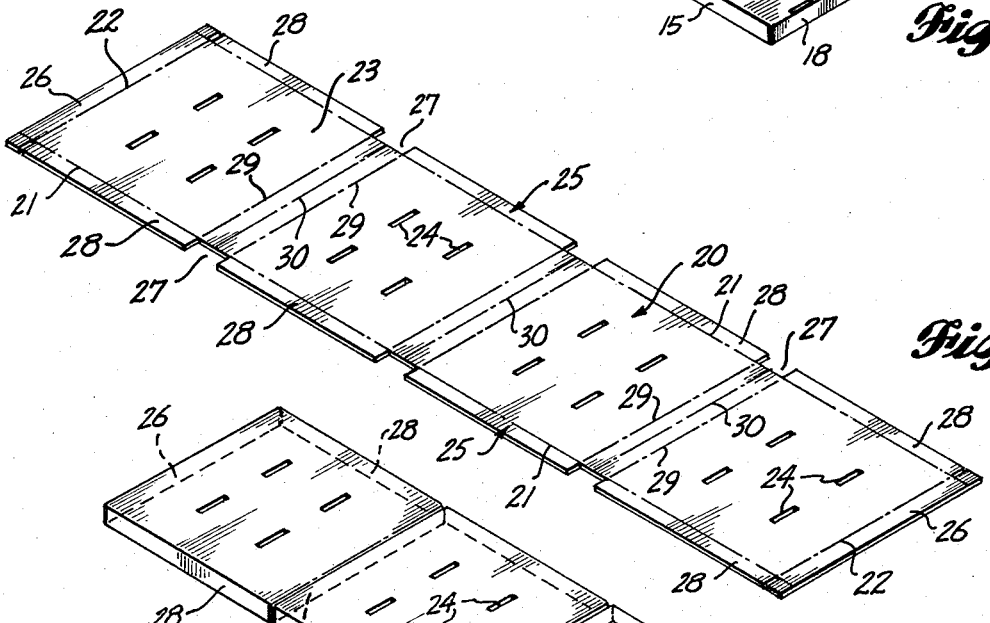
FIG. 11 is a top perspective of another alternative embodiment of an insulation-confining panel in accordance with the present invention.

The embodiment of the present invention shown in FIG. 11, like the embodiments shown in FIGS. 1 and 2, includes a generally rectangular semi-rigid sheet 20, having longitudinally extending parallel scores 21 each spaced inward of a longitudinal sheet edge and transverse or lateral scores 22 each spaced inward of a lateral sheet edge, dividing the sheet into a rectangular central portion 23 of width approximately equal to the distance between adjacent floor or roof-supporting members and having vent slits 24, as well as opposite longitudinal or side marginal portions 25 and opposite lateral or end marginal portions 26.

One major difference between the panel of FIG. 11 and the panels of FIGS. 1 and 2 is that, in the embodiment of FIG. 11, tabs corresponding to the short spacer tabs 11 shown in FIGS. 1 and 2 have been cut out, leaving rectangular recesses 27 between longitudinally extending panel-securing tabs 28. In addition, one surface of the sheet central portion 23, the upper surface, has transverse scores 29 extending between corresponding ends of corresponding tabs 28 at opposite sides of the sheet. The other surface of the sheet, the bottom surface, has transverse scores 30 each located centrally between a pair of scores 29 and extending between the centers of corresponding recesses 27.

Figure 11A:
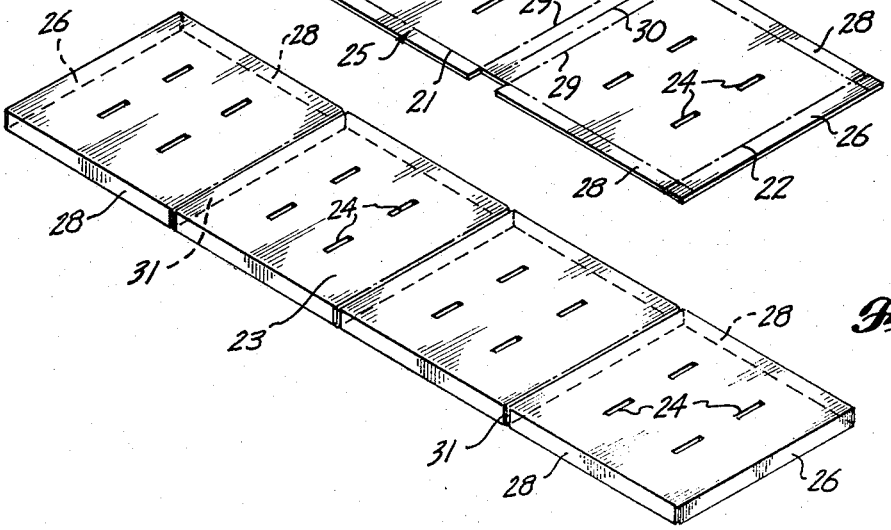
FIG. 11*a* is a top perspective of the panel of FIG. 11 prepared for being fitted between adjacent joists of a building structure.

The panel of FIG. 11 can be folded as shown in FIG. 11*a* for being installed with the sheet central portion 23 bridging between floor-supporting members spaced apart a substantial distance. The panel end marginal portions or tabs 26 and panel-securing tabs 28 are bent down, and the panel central portion 23 is creased along scores 29 and 30 to form integral return bent cross ribs 31 projecing downward from the panel central portion and extending widthwise of the sheet. Panels prepared in accordance with FIG. 11*a* are secured end-to-end between adjacent joists, forming a continuous insulation-confining space between the sheet central portions 23 and the surface supported by the joists. Insulation material then is blown between the sheet central portions and such surface as previously described.

The panel shown in FIG. 12 is identical to the panel of FIG. 11 with the exception that, in the panel of FIG. 12, short side tabs 32 between the longitudinally extending panel-securing tabs 28 have not been cut out. The transverse scores 30, on the bottom surface of the generally rectangular sheet 20 and between the upper scores 29, extend the full width of the sheet such that even the underside of tabs 32 are scored. Slots 33 between the long panel-securing tabs 28 and the short tabs 32 are in registration with the scores 29.

The panel of FIG. 12 is particularly advantageous for being installed with the sheet central portion 23 bridging between floor-supporting members spaced apart a large distance. For example, in the representative post and beam floor construction shown in FIGS. 13 and 14, concrete pads C support short vertical posts P such as "4×4" posts which, in turn, support horizontal beams B such as "4×6" beams spaced apart a large distance, for example 4 feet (1.2 meters) on center. Long lengths of flooring material F extend transversely of the lengths of beams B.

For being installed in such a floor system, the sheet end marginal portions or tabs 26 of a panel in accordance with FIG. 12 are bent down and the sheet is creased along scores 29 and 30 to form integral return bent cross ribs 31 extending widthwise of the sheet. As best seen in FIG. 13, the long panel-securing tabs 28, which are coplanar with the sheet central portion 23, are stapled to the bottoms of adjacent beams and, as best seen in FIG. 14, the downward bent end marginal portions 26 of adjacent panels can be stapled together such that a deep continuous insulation-confining space is formed between the sheet central portions and flooring F. Insulation material then is blown between the sheet central portions and the underside of flooring F as previously described.

A major advantage of use of an insulation-confining panel in accordance with the present invention is the formation of an enclosed insulation-confining space of a desired thickness, so that blowing of insulation material between a panel central portion and a generally horizontal surface can be continued until a compact mass of insulation material fills such space. Since, under normal conditions, settling of blown insulation material continues only until the material has a certain density, which can be referred to as the "settling density," if blowing of insulation material is continued until the density of the compact mass confined by the panel is at least equal to the settling density for that material, no appreciable settling will occur.

For most blown insulation materials, the settling density is about 2 pounds per cubic foot and, consequently, blowing of insulation material should be continued until the density of the confined compact mass of insulation material is at least 2 pounds per cubic foot. To achieve this density quickly, the aggregate area of the vent slits should be large enough to allow free escape of air as the insulation material is blown into position. Preferably, the ratio of the aggregate area of the vent slits in a panel central portion to the area of such panel central portion is at least 1:250. In addition, the vent slits should be scattered substantially uniformly throughout the area of the panel central portion. Such slits extend laterally of the sheet, parallel to each other, and are arranged in rows extending lengthwise of the sheet. As best seen in FIG. 2, each row of slits is spaced laterally from the adjacent row and from a longitudinal score 2 a distance equal to or greater than the length of a slit.

A further consideration for the vent slits is their width. The slits should be at least about $\frac{1}{8}$ inch (3.2 mm) wide to allow free escape of air, but should be no greater than about $\frac{3}{8}$ inch (9.5 mm) wide so that no insulation material is blown out through the slits.

Blown insulation material usually is blown into position under substantial pressure. For example, a representative back pressure for an insulation-blowing hose is 3.5 pounds per square inch. Consequently, during the blowing operation a panel in accordance with the present invention is subjected to substantial stress, particularly where the panel margins are secured to supporting members such as at staples S. The strength of the panel must be sufficient to prevent separation of the margins from the supporting members. Corrugated cardboard having a bursting strength of at least 200 pounds per square inch is preferred. For an installation where floor-supporting members are spaced two feet (61 cm) or more on center, integral return bent cross ribs should be provided sufficiently close to one another to provide an insulation-supporting surface having a supporting strength of at least 3 pounds per square foot. Using the preferred insulating-supporting panel in accordance with the present invention provides a substantially permanent installation requiring no maintenance or repair throughout the life of the building structure.

For each embodiment of the invention, suitable flame retardant can be sprayed onto one or both exposed surfaces of the corrugated cardboard sheet if desired or required by local building codes.

I claim:

1. A panel for confining blowable insulation material against a generally planar surface of a building structure comprising a sheet of substantially rigid material having two substantially parallel scores each spaced inward of an edge of said sheet, said scores dividing said sheet into a substantially rectangular central portion and opposite marginal tabs adjacent to said central portion which tabs are bendable along said scores so as to be disposed substantially perpendicular to said sheet central portion, said sheet central portion having several ventilation apertures scattered substantially uniformly throughout the area of said sheet central portion for permitting circulation of air through said sheet central portion, said apertures being small enough to prevent passage of a substantial amount of the blowable insulation material through said apertures.

2. The panel defined in claim 1, in which the sheet central portion has at least ten discrete ventilation apertures.

3. The panel defined in claim 1, in which the width of each of the ventilation apertures is at least about one-eighth inch.

4. The panel defined in claim 1, in which the width of each of the ventilation apertures is between about one-eighth inch and about three-eighths inch.

5. The panel defined in claim 1, in which the ratio of the aggregate area of the ventilation apertures to the area of the sheet central portion is at least 1:250.

6. The panel defined in claim 1, 2, 3, 4 or 5, in which the sheet central portion is elongated lengthwise of the scores and the ventilation apertures are arranged in rows extending lengthwise of the sheet central portion.

7. The panel defined in claim 1, 2, 3, 4 or 5, in which the ventilation apertures are elongated slits.

8. The panel defined in claim 7, in which the slits are substantially parallel.

9. The panel defined in claim 7, in which the sheet central portion is elongated lengthwise of the scores and the slits extend laterally of the sheet central portion.

10. The panel defined in claim 9, in which the sheet central portion is elongated lengthwise of the scores and the slits are arranged in rows extending lengthwise of the sheet central portion.

11. The panel defined in claim 10, in which the rows of elongated ventilation slits are spaced apart a distance at least equal to the length of one of the slits.

12. The panel defined in claim 10, in which the row of slits adjacent to each of the scores is spaced inward of such score a distance at least equal to the length of one of the slits.

13. In a building structure including a horizontal, substantially planar floor surface and several elongated, substantially horizontally extending floor support members supporting such floor surface and spaced apart substantially uniformly transversely of their lengths, the improvement comprising a generally rectangular, corrugated cardboard sheet having opposite longitudinal marginal portions and a central portion of a width substantially the same as the distance between adjacent floor support members, means securing said opposite longitudinal marginal portions of said sheet to separate floor support members for supporting said sheet central portion bridging between adjacent floor support members with the plane of said sheet central portion extending substantially horizontally and spaced beneath the floor surface, and a layer of blowable insulation between said sheet central portion and the floor surface, said sheet central portion having several discrete ventilation apertures scattered substantially uniformly throughout the area of said sheet central portion.

14. In a building structure including a substantially planar roof surface, several elongated, parallel support members supporting such roof surface and spaced apart substantially uniformly transversely of their lengths, and a substantially planar ceiling surface secured to the undersides of the support members and supported thereby, the improvement comprising a rectangular, substantially rigid sheet having a central portion of a width substantially the same as the distance between adjacent support members and extending substantially parallel to but spaced beneath the roof surface intermediate the roof surface and the ceiling surface, a layer of blowable insulation material confined between said sheet central portion and said ceiling surface, and spacer means projecting upward from said sheet central portion and engaging the underside of the roof surface for maintaining said sheet central portion spaced below the roof surface.

15. In a building structure including a horizontal, substantially planar floor surface and several elongated floor support members supporting such surface and spaced apart substantially uniformly transversely of their lengths, the improvement comprising a generally rectangular, corrugated cardboard sheet having respective upper and lower surfaces and a generally rectangular central portion, means securing opposite marginal portions of said sheet to separate floor support members such that said sheet central portion bridges between adjacent floor support members, said sheet having parallel outer scores extending laterally on the bottom surface of said sheet and another laterally extending score on the top surface of the sheet located centrally between said outer scores, said sheet being return bent along said central score so as to place the portions of the upper surface of said sheet between said central score and said outer scores in substantially face-to-face contact for forming an integral return bent cross ribs extending laterally of the sheet between the adjacent floor support members, and a layer of blowable insulation material confined between said sheet central portion and the floor surface.

16. In the building structure defined in claim 14 or 15, the sheet central portion having several discrete ventilation apertures scattered substantially uniformly throughout the area of the sheet central portion.

17. The method of insulating a horizontal, planar floor surface supported by elongated, parallel floor support members spaced apart substantially uniformly transversely of their lengths, which comprises securing to separate floor support members the opposite longitudinal margins of a generally rectangular, corrugated cardboard sheet including a substantially rigid, substantially planar central portion having several discrete ventilation apertures scattered substantially uniformly throughout the area of such central portion such that such central portion of such sheet bridges between adjacent support members, and then blowing a mixture of air and particulate insulation material into the space between the sheet central portion and the floor surface and thereby building up a layer of such insulation material in such space as air escapes through the apertures in the sheet central portion.

18. The method defined in claim 17, including blowing the particulate insulation material between the sheet central portion and the floor surface until the layer of particulate insulation material substantially fills the entire spaced between the sheet central portion and the floor surface.

19. The method defined in claim 17, including blowing the particulate insulation material between the sheet central portion and the floor surface until the density of the layer of particulate insulation material is at least two pounds per cubic foot.

20. The method defined in claim 17, including blowing the particulate insulation material between the sheet central portion and the floor surface until the density of the layer of particulate insulation is at least as great as the settling density of such material.

* * * * *